United States Patent [19]

Morris

[11] Patent Number: 4,506,183

[45] Date of Patent: Mar. 19, 1985

[54] HIGH THERMAL POWER DENSITY HEAT TRANSFER APPARATUS PROVIDING ELECTRICAL ISOLATION AT HIGH TEMPERATURE USING HEAT PIPES

[75] Inventor: James F. Morris, Tempe, Ariz.

[73] Assignee: The United States of America as represented by the Administrator of the National Aeronautics and Space Administration, Washington, D.C.

[21] Appl. No.: 507,626

[22] Filed: Jun. 24, 1983

Related U.S. Application Data

[63] Continuation-in-part of Ser. No. 202,228, Nov. 30, 1980, abandoned.

[51] Int. Cl.[3] ..... H01J 45/00

[52] U.S. Cl. ..... 310/306; 165/32; 165/104.14

[58] Field of Search ..... 310/306; 165/104.14, 165/32

[56] References Cited

U.S. PATENT DOCUMENTS

| | | | |
|---|---|---|---|
| 3,302,042 | 1/1967 | Grover et al. | 310/4 |
| 3,444,400 | 5/1969 | Janner et al. | 310/4 |
| 3,451,641 | 6/1969 | Leventhal | 244/1 |
| 3,537,515 | 11/1970 | Byrd | 165/105 |
| 3,548,222 | 12/1970 | Hobson | 310/4 |
| 3,578,991 | 5/1971 | Gross et al. | 310/4 |
| 3,621,906 | 11/1971 | Leffert | 165/32 |
| 3,629,063 | 1/1971 | Houston | 176/37 |
| 3,983,423 | 9/1976 | Rasor et al. | 310/4 R |
| 4,047,093 | 9/1977 | Levoy | 310/306 X |

*Primary Examiner*—Donovan F. Duggan

*Attorney, Agent, or Firm*—Norman T. Musial; John R. Manning; Gene E. Shook

[57] ABSTRACT

This invention is directed to transferring heat from an extremely high temperature source to an electrically isolated lower temperature receiver. The invention is particularly concerned with supplying thermal power to a thermionic converter from a nuclear reactor with electric isolation.

Heat from a high temperature heat pipe (10) is transferred through a vacuum or a gap filled with electrically nonconducting gas (26) to a cooler heat pipe (18). The heat pipe (10) is used to cool the nuclear reactor while the heat pipe (18) is connected thermally and electrically to a thermionic converter (22).

If the receiver requires greater thermal power density, geometries are used with larger heat pipe areas for transmitting and receiving energy than the area for conducting the heat to the thermionic converter. In this way the heat pipe capability for increasing thermal power densities compensates for the comparatively low thermal power densities through the electrically nonconducting gap between the two heat pipes.

8 Claims, 1 Drawing Figure

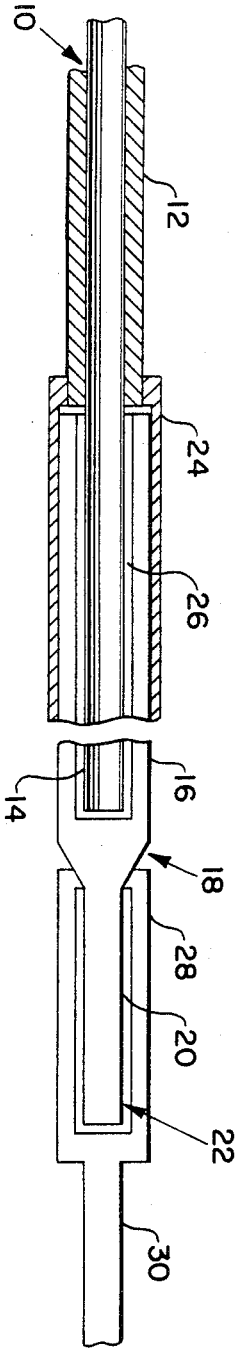
10
12
24
26
14
16
18
28
20
22
30

HIGH THERMAL POWER DENSITY HEAT TRANSFER APPARATUS PROVIDING ELECTRICAL ISOLATION AT HIGH TEMPERATURE USING HEAT PIPES

ORIGIN OF THE INVENTION

The invention described herein was made by an employee of the United States Government and may be manufactured and used by or for the Government for governmental purposes without the payment of any royalties thereon or therefor.

STATEMENT OF COPENDENCY

This application is a continuation-in-part of copending application Ser. No. 202,228 which was filed Nov. 30, 1980 and is now abandoned.

TECHNICAL FIELD

This invention is concerned with transferring heat from an extremely high temperature source to a thermionic converter. The invention is particularly applicable to the use of a high temperature thermionic energy converter with a heat pipe cooled reactor.

It has been proposed to transport the heat produced in a nuclear reactor to the emitting surfaces of thermionic diodes located outside the reactor. For power conditioning purposes it is desirable to electrically isolate the thermionic energy converters from the heat pipes that cool the reactor.

While the heat pipes are capable of supplying very high thermal power densities to the thermionic converter, problems of electric isolation have been encountered. Conventional insulators deteriorate in such applications because of the extremely high temperatures involved.

BACKGROUND ART

Janner et al U.S. Pat. No. 3,444,400, Hobson U.S. Pat. No. 3,548,222, and Gross et al U.S. Pat. No. 3,578,991 disclose thermionic converter fuel elements. The thermionic converters are heated by inserting the fuel elements directly into the cores of nuclear reactors.

The thermionic converter disclosed in Rasor et al U.S. Pat. No. 3,983,423 has a heat source for heating an emitter. This heat source may be a nuclear reactor fuel element, hot liquid metal flowing in a tube, or other means.

Leventhal U.S. Pat. No. 3,451,641 teaches the use of a heat pipe to transfer heat from a nuclear reactor to a thermal electric converter.

Leffert U.S. Pat. No. 3,621,906 is directed to a control system for heat pipes which assures electrical conduction between the input and output heat pipes. A complex structure is relied on to vary the rate of heat transport between the heat source, such as a heat pipe, and a heat sink, which may be another heat pipe.

Grover et al patent No. 3,302,042 is directed to a nuclear heat source having a thermionic converter load. The heat pipes in the reactor are joined by solid materials.

Byrd U.S. Pat. No. 3,537,515 describes a power system having a number of thermionic diodes connected in parallel. The diodes use heat pipes as cathodes.

DISCLOSURE OF INVENTION

This invention is based on the phenomenon that heat pipes not only transport high thermal power densities, but also transform thermal power densities. More particularly, a heat pipe can receive heat through its evaporator walls at low thermal power densities and deliver heat through its condenser walls at much higher thermal power densities.

According to the invention, heat is transferred from a high temperature heat pipe having an evaporator that cools a high temperature heat source, such as a nuclear reactor, to a cooler heat pipe connected thermally and electrically to the intended receiver, which is the emitter in a thermionic converter. More particularly, the condenser of the high temperature heat pipe heats the evaporator of the thermionic converter heat pipe. The condenser of this cooler heat pipe forms the emitter of the thermionic converter. This heat is transferred between the heat pipes through a vacuum or electrically non-conducting gas.

A collector in the form of a sodium heat pipe is spaced from the emitter heat pipe. The evaporator of the sodium heat pipe forms the collector of the thermionic converter. This collector receives electric energy, thermal conduction, and radiant heat from the emitter. The collector heat pipe operates at a temperature of about 1000° K. At this temperature a solid insulator may be used to cover and electrically isolate the collector.

If the receiver requires greater thermal power densities than those transferred between the two heat pipes, geometries are used with larger heat pipe areas for transmitting and receiving energy than the area for conducting the heat to the receiver. In this manner the heat pipe capability for "stepping up" thermal power densities compensates for the comparatively low thermal power densities through the electrically non-conducting gap between the heat pipes.

BRIEF DESCRIPTION OF THE DRAWING

The details of the invention will be described in connection with the accompanying drawing which is an axial section view taken through a system of heat pipes constructed in accordance with the present invention.

BEST MODE FOR CARRYING OUT THE INVENTION

Referring to the drawing there is shown a tubular heat pipe extending from a nuclear reactor, not shown. It is contemplated that both the wick and the envelope of this heat pipe may be of a tungsten, 25% rhenium alloy. The heat pipe is converted with a non-contacting multifoil radiation shield 12.

The heat pipe 10 operates at a temperature of about 1900° K. and contains lithium as the working fluid. The evaporator of the lithium heat pipe 10 cools a high temperature heat source, such as the core of a nuclear reactor, in a manner well known in the art.

The heat pipe 10 has a tubular condenser 14 that extends into an annular evaporator portion 16 of a heat pipe 18 having a condenser portion 20 which forms the emitter of a thermionic converter 22. The wick and envelope of the heat pipe 18 preferably are of a molybdenum alloy, although a tungsten, 25% rhenium alloy could be used. Here again, a non-contacting multifoil radiation shield 24 covers the heat pipe 18, and lithium is the working fluid.

The tubular condenser 20 of the heat pipe 18 extends into an annular evaporator portion 28 of a third heat pipe. The inner surface of the evaporator portion 28 forms the collector of the thermionic converter 22, and heat from the evaporator 28 is transported to a condenser portion 30 at the opposite end. The collector heat pipe uses sodium as its working fluid, which operates at about 1000° K. At this temperature a solid insulator may be used with the collector.

An important feature of the invention is that the heat pipes 10 and 18 are electrically isolated from each other. More particularly, the heat pipe 10 is spaced inwardly from the heat pipe 18 to form an annular chamber 26 which may be evacuated. Or an electrically non-conducting gas may fill this chamber 26 between these heat pipes.

In space applications the chamber 26 is in communication with the hard vacuum of the environment to insure a vacuum gap. A large diaphragmatic thermal (electric) choke may be used to contain the electrically insulating gas. Such a choke comprises two diaphragmatic elements separated by a solid insulator that is located in a relatively cool position remote from the hot heat pipe in a conventional manner. These chokes are characterized by large conducting lengths and small conducting cross sections.

The black body radiation of the high temperature heat pipe 10 operating at 1900° K. 74 W/cm$^2$. The emitter heat pipe 18 which is heated by this radiation operates at about 1700° K. At this temperature the black body radiation of the heat pipe 18 is about 47.4 W/cm$^2$.

The assumed emissivities of the reactor and converter-emitter heat pipes in the drawing are 0.3. This gives a form factor of 0.176 for a very small vacuum gap. The thermionic converter 22 is assumed to generate 4.7 W/cm$^2$ of electric output at 20% efficiency. More particularly, for the 1900° K. heat pipe 10, the 1700° K. heat pipe 18, and the small intervening vaccum gap 26, the net radiant heat transfer, $q_r=F(q_{BB,HT}-q_{BB,LT})$, equals the form factor (0.176) times the difference of the 1900° K. and 1700° K. black body radiation thermal power densities (74 W/cm$^2$−47.4 W/cm$^2$). Therefore, $q=0.176\ (74-47.4)=4.68$ W/cm$^2$.

In this embodiment approximately 5 times as much area is required for the radiant-heat transfer between the heat pipes as for the total power transfer across a 10 mil converter electrode gap. The heat pipes readily allow such transformation of thermal power densities. Also, the vacuum gap between the heat pipes isolates the thermionic converter electrically.

For the previously cited example, using an 1850° K. heat pipe 10 and a 1750° K. heat pipe 18 results in half the heat pipe 10—to −18 radiant flux compared with the 1900° K.-1700° K. example; $q_r=0.176\ (66.6-53.3)=2.34$ W/cm$^2$. Therefore, the 1850° K.-1750° K. embodiment will require twice the area calculated for the 1900° K.-1700° K. radiant heat transfer or ten times the thermionic emitter area.

Using a one-tenth millimeter gap filled with electrically non-conducting gas rather than vacuum between heat pipes 10 and 18 will intensify heat transfer. This can be illustrated by considering 1800° K. gases at one atmosphere. Between less than 0.01 atmosphere and 10 atmospheres, the effect of pressure on thermal conductivity of gas is small, being about one percent per atmosphere, and can be ignored in this example.

Helium would add to the radiant heat transfer 0.50 times the heat-pipe temperature difference, ΔT, in W/cm$^2$. Neon would add 0.15 ΔT W/cm$^2$, and argon would add 0.059 ΔT W/cm$^2$. Also, the radiant heat transfer is 4.68/200=0.0234 W/cm$^2$/°K., for the 1900° K.-1700° K. embodiment and 2.34/100=0.0234 W/cm$^2$°K. for the 1850° K-1750° K. embodiment. Thus, instead of 4.68 W/cm$^2$ for the vacuum 1900° K.-1700° K. embodiment, the use of helium would result in $q=(0.0234+0.50)\ 200=104.7$ W/cm$^2$. For neon, $q=(0.0234+0.15)\ 200=34.7$ W/cm$^2$, and for argon, $q=(0.0234+0.059)\ 200=16.5$ W/cm$^2$. Because the requirement of the thermionic converter of the example is about 23.5 W/cm$^2$, the heat pipe would reduce thermal power densities for the helium and neon gaps and increase them for the argon and vacuum gaps.

Instead of 2.34 W/cm$^2$ for the vacuum 1850° K.-1750° K. embodiment, the use of helium results in $q=(0.0234+0.50)\ 100=52.3$ W/cm$^2$. The use of neon results in 17.3 W/cm$^2$ and argon produces 8.24 W/cm$^2$. In this example the heat pipe would reduce the thermal power density for the helium gap and increase it for the neon, argon, and vacuum gaps. Thus, the utilization of electrically non-conducting gases enhances heat transfer between the heat pipes 10 and 18, which would adapt the resulting thermal power densities to the thermionic converter needs.

It is apparent that the heat pipes 10 and 18 have the capability for "stepping up" or "stepping down" thermal power densities. This transforming compensates for the comparatively low thermal power densities through the electrically non-conducting vacuum or argon gap 26 between these two heat pipes or for the high thermal power densities through the helium gap. It is also apparent this effect is modular and can be used repeatedly parallel to transfer the total amount of heat required.

Although the invention has been described relative to an exemplary embodiment thereof, it will be understood that variations and modifications can be effected in this embodiment without departing from the spirit of the invention or the scope of the subjoined claims.

I claim:

1. A high thermal power density heat transfer apparatus for transferring heat from an extremely high temperature source to an electrically isolated lower temperature receiver comprising a first heat pipe of a tungsten-rhemium alloy containing a lithium working fluid for operation between about 1850° K. and about 1900° K., said first heat pipe comprising an evaporator portion at one end thereof in thermal communication with said high temperature source, and a tubular condenser portion at the opposite end thereof for a receiving heat from said evaporator portion, and a second heat pipe of an alloy of a metal selected from the group consisting essentially of molybdenum and tungsten containing a lithium working fluid for operation between about 1700° K. and about 1750° K., said second heat pipe being positioned between said first heat pipe and said lower temperature receiver for transferring heat from said first heat pipe to said receiver, said second heat pipe comprising an annular evaporator portion having an inside diameter greater than the outside diameter of said tubular condenser portion of said first heat pipe, said tubular condenser portion of said first heat pipe extending into said annular evaporator portion of said second heat pipe and being spaced therefrom to form an annular chamber having opposed walls spaced from each other whereby said evaporator portion of said second heat pipe is in thermal communication with and electrically isolated from said condenser portion of said first heat pipe with no solid insulating material in contact with either heat pipe, and a tubular condenser portion at the opposite end thereof connected thermally and electrically to said receiver.

2. Apparatus as claimed in claim 1 wherein the extremely high temperature heat source comprises a nuclear reactor.

3. Apparatus as claimed in claim 1 wherein the lower temperature receiver comprises a thermionic converter having an emitter formed by said condenser portion of said second heat pipe spaced from a collector.

4. An apparatus as claimed in claim 3 including a third heat pipe containing a sodium working fluid for operation at about 1000° K. wherein the thermionic converter comprises an emitter formed by the tubular condenser portion of the second heat pipe, and a collector formed by the evaporator portion of the third heat pipe.

5. Apparatus as claimed in claim 4 wherein the evaporator portion of the third heat pipe has an annular configuration, and the tubular condenser portion of the second heat pipe extends into said annular evaporator portion of said third heat pipe and is spaced therefrom to form an annular chamber having opposed walls spaced from each other whereby said evaporator portion of said third heat pipe is in thermal communication with and electrically isolated from said condenser portion of said first heat pipe.

6. Apparatus as claimed in claim 1 wherein the chamber between the condenser portion of the first heat pipe and the evaporator portion of the second heat pipe is evacuated.

7. Apparatus as claimed in claim 1 wherein the chamber between the condenser portion of the first heat pipe and the evaporator portion of the second heat pipe is filled with an electrically non-conducting gas.

8. Apparaatus as claimed in claim 1 wherein the condenser portion of the first heat pipe is spaced from the evaporator portion of the second heat pipe a distance of about one millimeter.

* * * * *